US010150044B2

(12) United States Patent
Shlomot

(10) Patent No.: US 10,150,044 B2
(45) Date of Patent: Dec. 11, 2018

(54) COMPUTERIZED YO-YO

(71) Applicant: Eyal Shlomot, Long Beach, CA (US)

(72) Inventor: Eyal Shlomot, Long Beach, CA (US)

( * ) Notice: Subject to any disclaimer, the term of this patent is extended or adjusted under 35 U.S.C. 154(b) by 0 days.

(21) Appl. No.: 15/344,597

(22) Filed: Nov. 7, 2016

(65) Prior Publication Data

US 2017/0050116 A1 Feb. 23, 2017

Related U.S. Application Data

(63) Continuation of application No. 14/620,221, filed on Feb. 12, 2015, now abandoned.

(51) Int. Cl.

| | |
|---|---|
| ***A63H 1/30*** | (2006.01) |
| ***A63H 1/24*** | (2006.01) |
| ***A63H 1/26*** | (2006.01) |
| ***A63H 1/28*** | (2006.01) |
| ***A63H 33/26*** | (2006.01) |

(Continued)

(52) U.S. Cl.

CPC ..... *A63H 1/30* (2013.01); *A63H 1/24* (2013.01); *A63H 1/26* (2013.01); *A63H 1/28* (2013.01);

(Continued)

(58) Field of Classification Search

None

See application file for complete search history.

(56) References Cited

U.S. PATENT DOCUMENTS 1,760,622 A * 5/1930 Aronson ..... A63H 33/36 446/22
1,949,858 A * 3/1934 Brown ..... A63H 33/36 446/22

(Continued)

FOREIGN PATENT DOCUMENTS

JP 2013094601 A * 5/2013
JP 2015025843 A * 2/2015

*Primary Examiner* — John E Simms, Jr.
*Assistant Examiner* — Urszula M Cegielnik

(57) ABSTRACT

There described a computerized yo-yo toy that uses an acceleration measuring device, a computation and control device, a communication device and entertaining devices to enhance the entertaining experience of playing with the computerized yo-yo toy. The acceleration measuring device measures the acceleration values of the computerized yo-yo toy. The computation and control device uses the measured acceleration values to generate control signals to control the entertaining devices such as a light display device, an audio play device and an auxiliary device for an enhanced entertaining experience. The entertaining devices may be latched to a latching base, which allows using different and new entertaining devices with the computerized yo-yo toy. The computation and control device may also use the measured acceleration values to generate control signals to control the motion of the computerized yo-yo toy, using an electric clutch device and an electric motor device. The control signals are based on the measured acceleration values, the type of entertaining device latched to the latching base and setup parameters received by the communication device from an external device, such as smartphone or tablet. The communication deice may also send data from the computerized yo-yo toy to the external device, which allows the external device to analyze, store or display the data for an enhanced entertaining experience.

12 Claims, 11 Drawing Sheets

A Schematic Side-View Cut of a Latching Base in a Computerized Yo-Yo

(51) Int. Cl.
*F21V 33/00* (2006.01)
*H04R 1/02* (2006.01)
*F21Y 115/10* (2016.01)

(52) U.S. Cl.
CPC ..... *A63H 33/26* (2013.01); *F21V 33/008* (2013.01); *H04R 1/028* (2013.01); *F21Y 2115/10* (2016.08)

(56) References Cited

U.S. PATENT DOCUMENTS 2,517,849 A * 8/1950 De Vincent ..... A63H 1/24 446/22
2,676,432 A * 4/1954 Field ..... A63H 1/30 446/251
3,010,248 A * 11/1961 Ellman ..... A63H 1/32 446/22
3,052,060 A * 9/1962 Wohlstrom ..... A63H 1/32 446/22
3,089,277 A * 5/1963 Milous, Jr. ..... A63H 1/30 446/176
3,256,635 A * 6/1966 Radovan ..... A63H 1/30 446/251
4,327,518 A * 5/1982 Knauff ..... A63H 1/24 446/242
4,555,235 A * 11/1985 Burroughs ..... A63H 1/22 446/243
4,775,948 A * 10/1988 Dial ..... A63B 43/00 368/250
5,145,444 A * 9/1992 Vankuiken ..... A63H 1/24 446/242
5,356,328 A * 10/1994 Ho ..... A63H 1/24 446/242
5,791,966 A * 8/1998 Capps ..... A63H 1/24 362/249.16
6,287,193 B1 * 9/2001 Rehkemper ..... A63H 1/30 273/142 H
6,428,415 B1 * 8/2002 Ohba ..... A63F 13/02 463/31
6,520,826 B2 * 2/2003 Spector ..... A61L 9/12 239/60
6,527,610 B1 * 3/2003 Hornsby ..... G04G 9/0064 368/10
6,634,922 B1 * 10/2003 Driscoll ..... A63H 1/30 273/142 R
6,695,670 B1 * 2/2004 Driscoll ..... A63H 1/30 273/142 R
6,699,090 B1 * 3/2004 Vick ..... A61L 9/12 446/369
6,802,758 B2 * 10/2004 Somers ..... A63H 1/10 446/242
7,037,169 B2 * 5/2006 Benedek ..... A63H 1/00 446/242
7,081,033 B1 * 7/2006 Mawle ..... A61F 13/02 446/175
7,101,315 B2 * 9/2006 Chuang ..... A63B 21/225 446/235
7,291,052 B2 * 11/2007 Ellman ..... A63H 3/16 446/100
7,427,153 B1 * 9/2008 Jacobs ..... G02B 6/0008 362/249.01
7,871,013 B2 * 1/2011 Schumann ..... G06Q 20/105 206/459.1
7,896,256 B2 * 3/2011 Robbinis-Sullivan ... A44C 7/00 239/36
7,980,913 B1 * 7/2011 D'Avanzo ..... A63H 18/02 446/175
8,152,587 B1 * 4/2012 Brown ..... A63H 3/005 206/216
8,328,595 B2 * 12/2012 Van Dan Elzen ..... A63H 1/30 446/247
8,376,807 B2 * 2/2013 Fogarty ..... A63H 33/26 446/369
9,079,112 B2 * 7/2015 Hasegawa ..... A63H 1/30
9,488,347 B1 * 11/2016 Brookins ..... F21V 21/00
9,737,822 B2 * 8/2017 Kubo ..... A63H 1/04
2005/0052883 A1 * 3/2005 Qi ..... A47G 33/06 362/555
2006/0166745 A1 * 7/2006 Lo ..... A63F 13/08 463/46
2007/0105477 A1 * 5/2007 Wong ..... A63H 1/30 446/250
2008/0214088 A1 * 9/2008 Chu ..... A63H 1/06 446/248
2008/0242186 A1 * 10/2008 Amireh ..... A63H 27/02 446/57
2008/0254708 A1 * 10/2008 Amadio ..... A63H 17/262 446/95
2009/0149106 A1 * 6/2009 D'Alleva ..... A45C 1/12 446/8
2011/0217897 A1 * 9/2011 Sackley ..... A63H 29/22 446/26
2011/0269365 A1 * 11/2011 Goff ..... A63H 3/00 446/72
2011/0292673 A1 * 12/2011 Aono ..... B60Q 1/0011 362/553
2012/0140481 A1 * 6/2012 Simchak ..... F21V 7/07 362/296.07
2015/0109812 A1 * 4/2015 Greb ..... G02B 6/0008 362/555
2015/0367244 A1 * 12/2015 Paul ..... A63H 33/002 446/242
2016/0184722 A1 * 6/2016 Kathavate ..... A63H 30/04 446/465

* cited by examiner

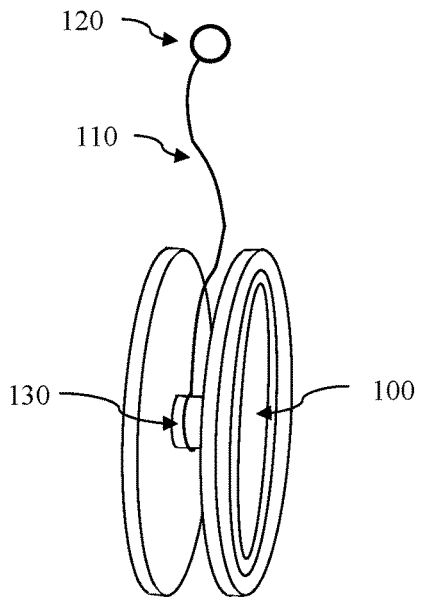
Figure 1 – A Schematic Diagram of a Simple Traditional Yo-Yo
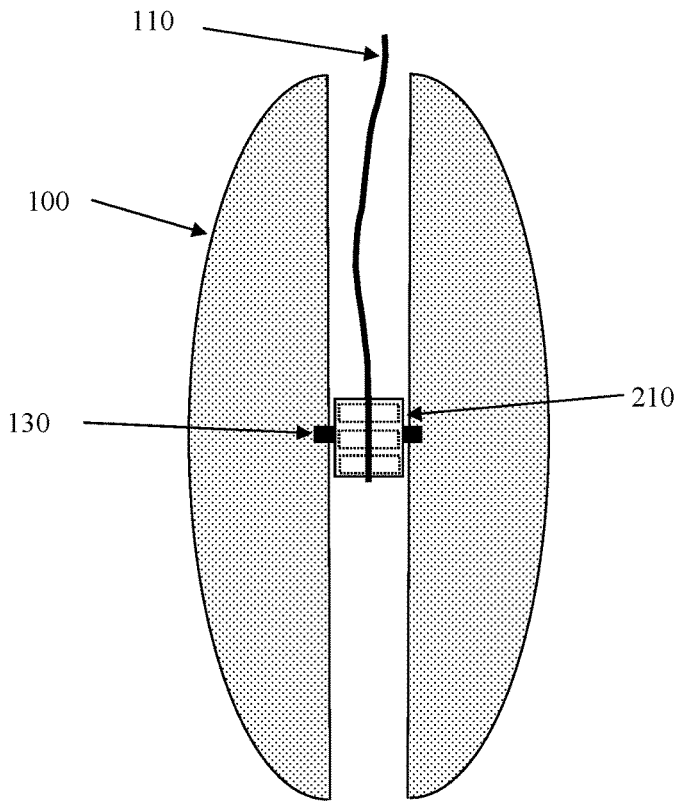
Figure 2 – A Schematic Side-View Diagram of a Ball Bearing Yo-Yo

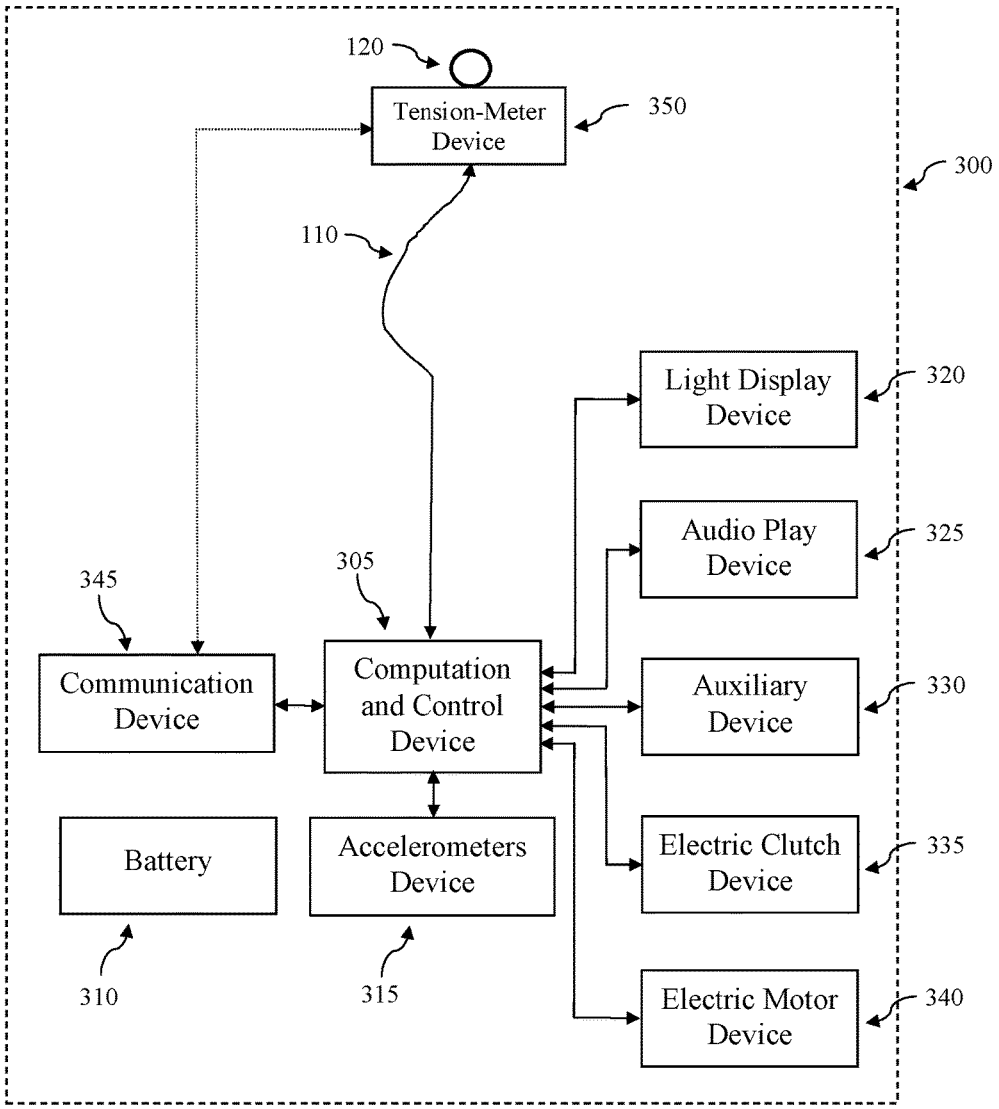
Figure 3 – A Schematic Diagram of Devices that may be Incorporated in a Computerized Yo-Yo

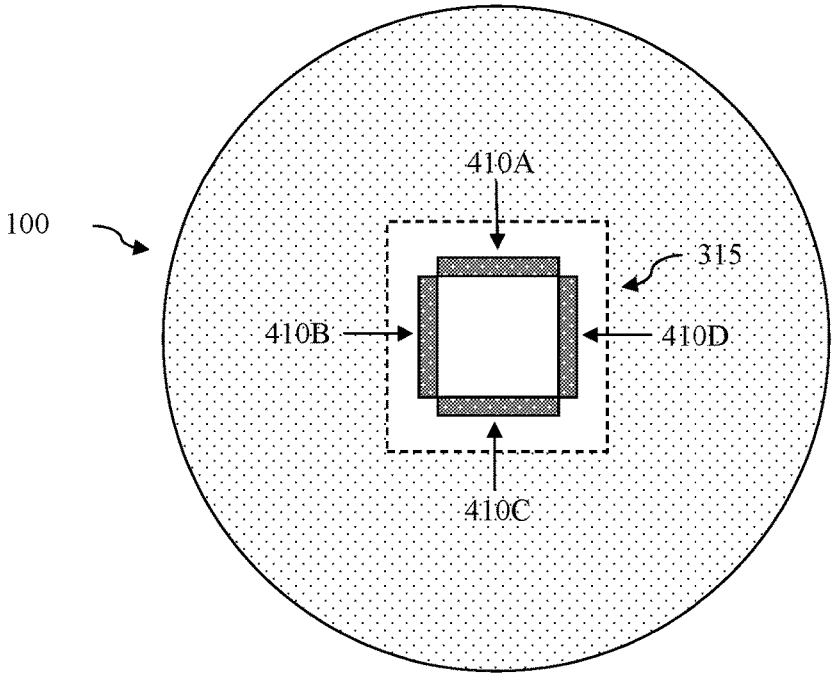
Figure 4 – A Schematic Diagram of an Optional Accelerometers Configuration in a Computerized Yo-Yo (Not to Scale)

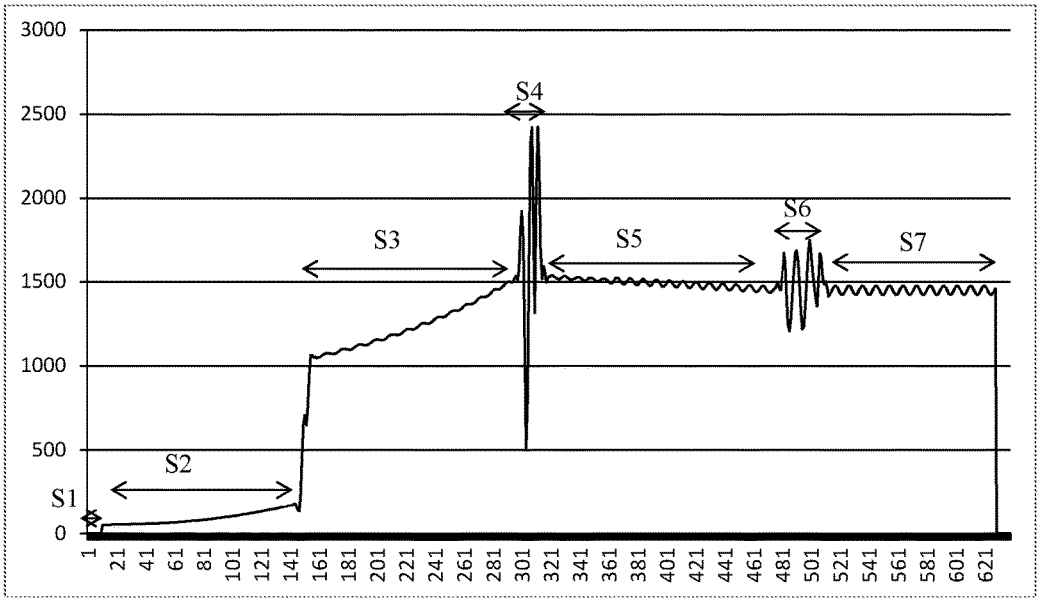
Figure 5 – An Example of an Acceleration Curve for a Yo-Yo Game Sequence

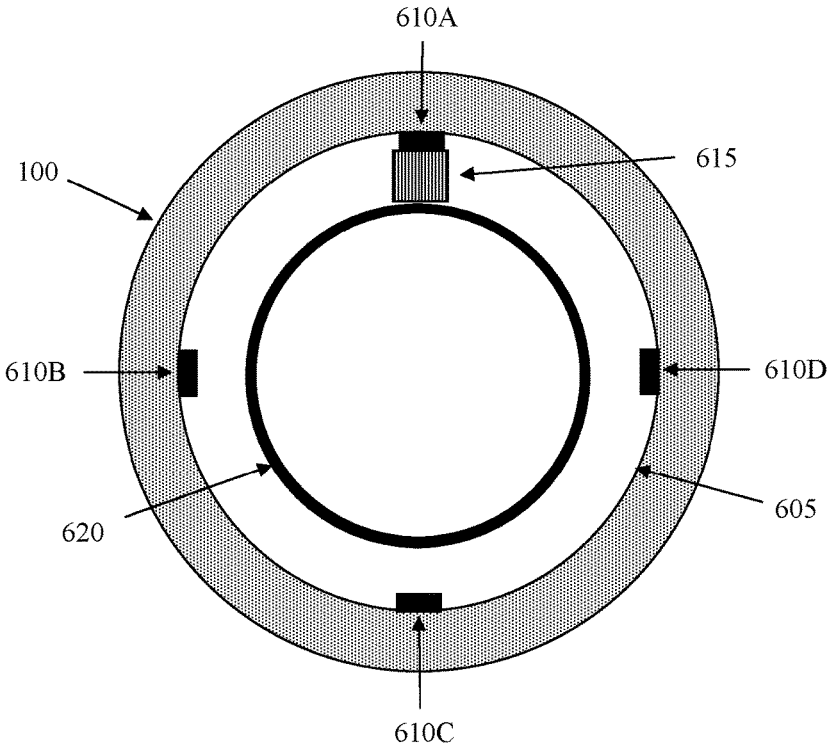
Figure 6A – A Schematic Top-View of a Latching Base in a Computerized Yo-Yo
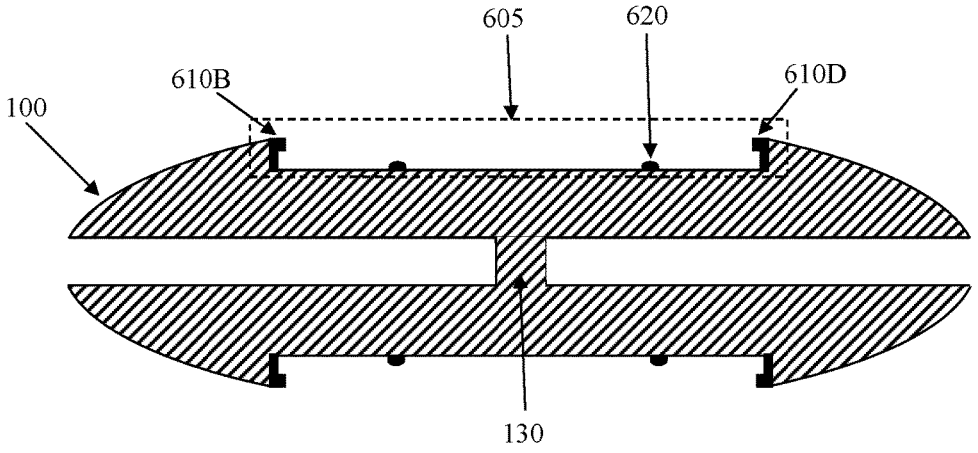
Figure 6B – A Schematic Side-View Cut of a Latching Base in a Computerized Yo-Yo

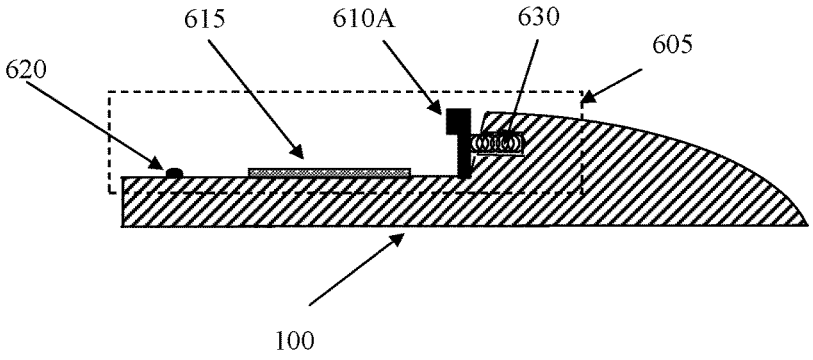
Figure 6C – A Side-View Cut of a Detail in a Latching Base in a Computerized Yo-Yo
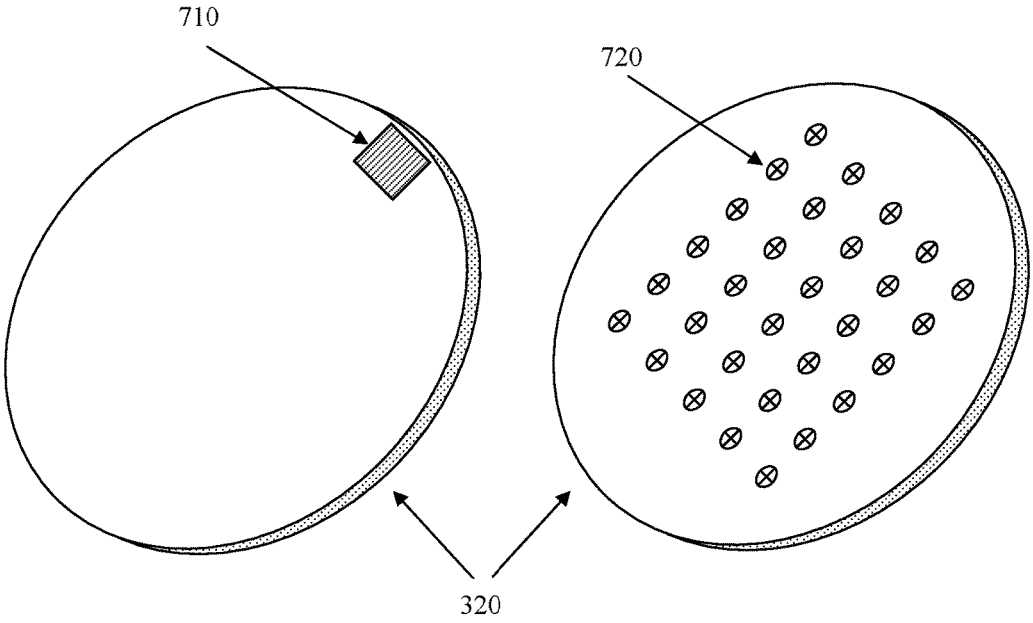
Figure 7 – A Schematic Diagram of Up (on right) and Down (on left) Sides of a Detachable Light Display Device with LEDs in a Computerized Yo-Yo

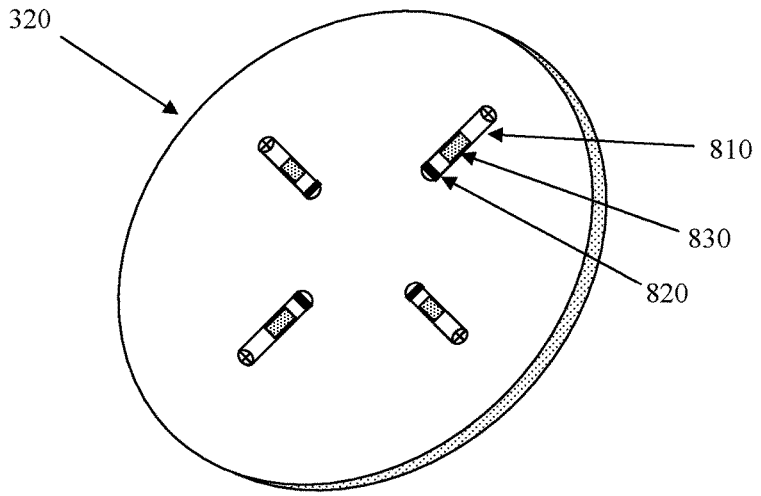
Figure 8 – A Schematic Diagram of Up Side of a Detachable Light Display Device with Lasers in a Computerized Yo-Yo
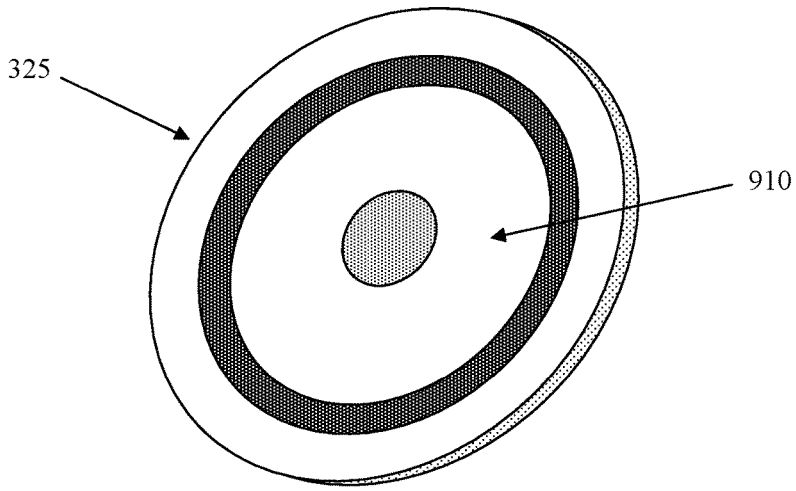
Figure 9 – A Schematic Diagram of Up Side of a Detachable Audio Play Device in a Computerized Yo-Yo

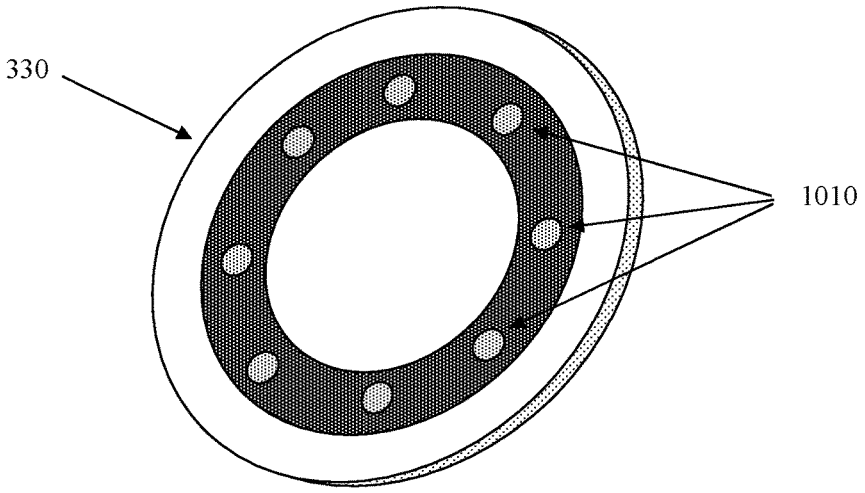
Figure 10 – A Schematic Diagram of Up Side of an Auxiliary Device in a Computerized Yo-Yo

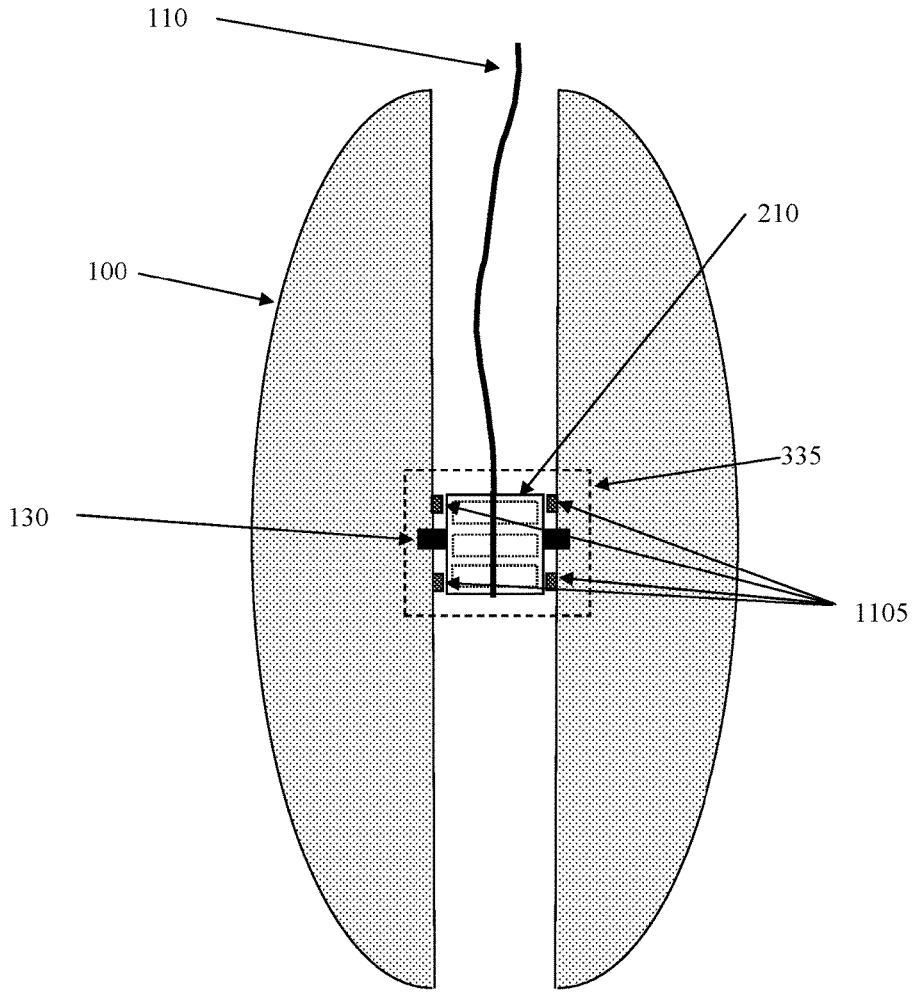
Figure 11 – A Schematic Side-View Diagram of an Electric Clutch Device in a Computerized Yo-Yo

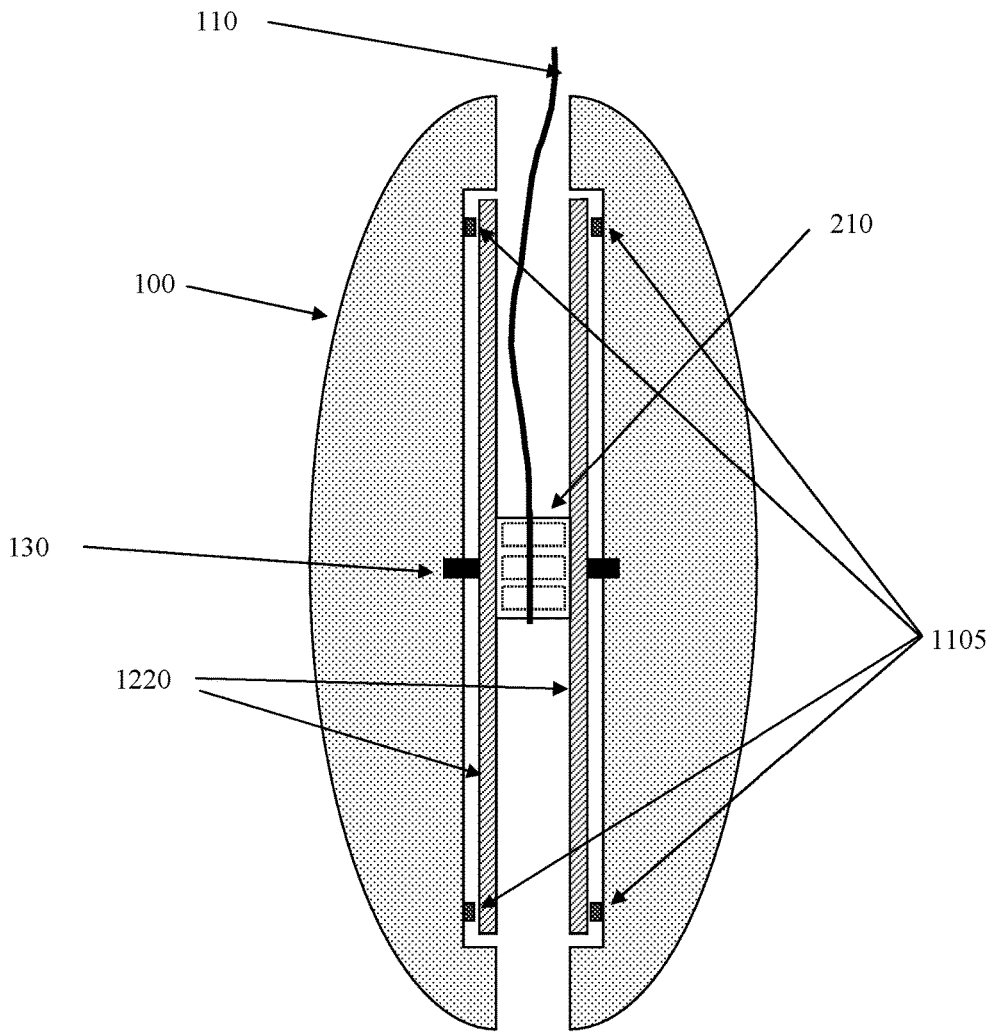
Figure 12 – A Schematic Side-View Diagram of Internal Disks and an Electric Clutch Device in a Computerized Yo-Yo

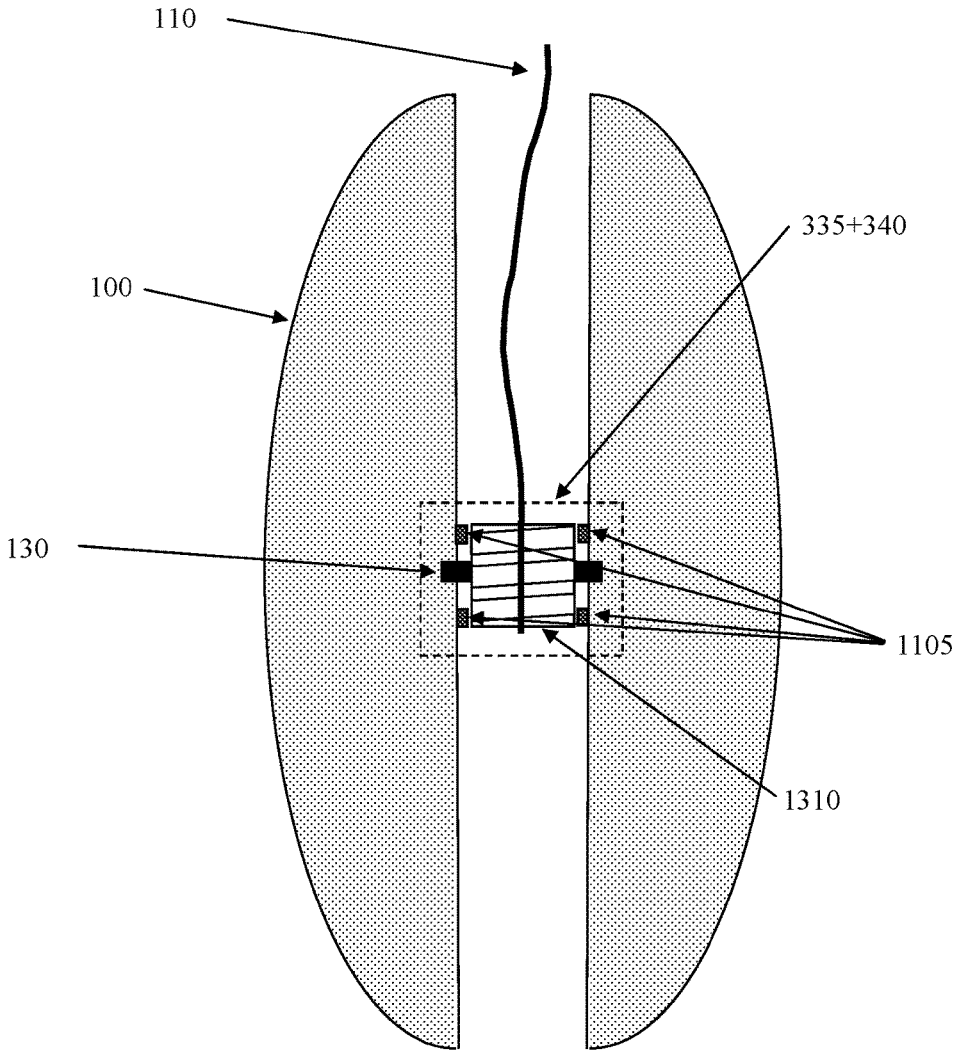
Figure 13 – A Schematic Side-View Diagram of an Electric Clutch Device and an Electric Motor Device in a Computerized Yo-Yo

COMPUTERIZED YO-YO

This application is a continuation of U.S. application Ser. No. 14/620,221 filed on Feb. 12, 2015

BACKGROUND OF THE INVENTION

1. Field of the Invention

The present invention relates to a computerized yo-yo toy. The computerized yo-yo comprises of devices that entertain the yo-yo player with programmable lights, sounds and other features, which operate according to the computerized yo-yo motion and states. In addition, the computerized yo-yo may comprise of devices that control the movement of the computerized yo-yo, such as an electric clutch and an electric motor.

2. Background Art

Yo-yo is one of the oldest toys. It is believed to have originated in China, but the first recorded yo-yo toy appears in Greek paintings circa 500 BC. Modern yo-yo toys use the same concept as ancient yo-yo toys but may be made of modern materials (e.g. plastic or metal alloys), may have different shapes (e.g., a butterfly shaped yo-yo) and may incorporate modern mechanical technologies (e.g., rotating ball bearings).

Some commercially available yo-yo toys may incorporate electronic components in addition to the mechanical components. An existing yo-yo toy includes a battery, lights and a mechanism for turning the lights on and off for added entertainment. This concept and some of its more advanced variants, such as adding audio playing, LCD displays, control and feedback, etc., are described, for example, in U.S. Pat. Nos. 4,327,518, 5,145,444, 5,356,328, 5,791,966, 6,287,193, 6,634,922 and 6,695,670.

Some commercially available yo-yo toys may also incorporate improved mechanical components that enhance the entertaining experience of playing with the yo-yo toys. For example, a currently marketed yo-yo includes a centrifugal mechanical clutch that opens when the yo-yo spins very fast, allowing long "sleep" (the fast spinning of the yo-yo at the end of the string) and automatic "wake-up" (the fast return of the yo-yo to the player hand from the "sleep" position). Yet other advanced combinations of mechanical and electrical components that allow enhanced control of the yo-yo motions are described in U.S. Pat. Nos. 7,448,934 and 8,187,052.

The current invention describes a computerized yo-yo that incorporates advanced electrical, mechanical and electromechanical components that provide further entertaining features and therefore further enhance the entertaining experience of playing with the yo-yo toy.

BRIEF DESCRIPTION OF THE DRAWINGS

The features and advantages of the present invention will become more readily apparent to those ordinarily skilled in the art after reviewing the following detailed description and accompanying drawings, wherein:

FIG. 1 is a schematic diagram of a simple traditional yo-yo.

FIG. 2 is a schematic side-view diagram of a ball-bearing yo-yo.

FIG. 3 is a schematic diagram of devices that may be incorporated in a computerized yo-yo.

FIG. 4 is a schematic diagram of an optional accelerometers configuration in a computerized yo-yo.

FIG. 5 illustrates an example of an acceleration curve for a yo-yo game sequence.

FIG. 6A is a schematic top-view of a latching base in a computerized yo-yo.

FIG. 6B is a schematic side-view cut of a latching base in a computerized yo-yo.

FIG. 6C is a schematic side-view cut of a detail in a latching base in a computerized yo-yo.

FIG. 7 is a schematic diagram of up and down sides of a detachable light display device with LEDs in a computerized yo-yo.

FIG. 8 is a schematic diagram of up side of a detachable light display device with lasers in a computerized yo-yo.

FIG. 9 is a schematic diagram of up side of a detachable audio play device in a computerized yo-yo.

FIG. 10 is a schematic diagram of up side of an auxiliary device in a computerized yo-yo.

FIG. 11 is a schematic side-view diagram of an electric clutch device in a computerized yo-yo.

FIG. 12 is a schematic side-view diagram of internal disks and an electric clutch in a computerized yo-yo.

FIG. 13 is a schematic side-view diagram of an electric clutch device and an electric motor device in a computerized yo-yo.

DETAILED DESCRIPTION OF THE INVENTION

The present invention is directed to a computerized yo-yo that incorporates advanced electrical, mechanical and electromechanical components that provide entertaining features and therefore enhance the entertaining experience of playing with the yo-yo toy. Although the invention is described with respect to specific embodiments, the principles of the invention can obviously be applied beyond the specifically described embodiments of the invention described herein. Moreover, in the description of the present invention, certain details have been left out in order to not obscure the inventive aspects of the invention. The details left out are within the knowledge of a person of ordinary skill in the art.

The drawings in the present application and their accompanying detailed description are directed to merely example embodiments of the invention. To maintain brevity, other embodiments of the invention which use the principles of the present invention are not specifically described in the present application and are not specifically illustrated by the present drawings. It should be borne in mind that, unless noted otherwise, like or corresponding elements among the figures may be indicated by like or corresponding reference numerals.

The current invention, in whole or in parts, can be also used in other similar rotating toys such as Frisbee discs, tops (or spin-tops), dreidels or any other rotating toys or devices.

The goal of any game is to entertain the players of the game. A game with many features and options might therefore be more entertaining, i.e., it may provide better entertaining experience. FIG. 1 shows a schematic diagram of a simple traditional yo-yo. The traditional yo-yo body 100 may be made of traditional materials such as wood or ceramic, or of modern materials such as metal alloy, plastic or any other material. Yo-yo body 100 is made of two rounded halves, which may be flat, spherical, conic shaped or any other rounded suitable shape. Yo-yo axel 130 connects the two rounded halves of yo-yo body 100 and therefore the yo-yo exhibits a symmetrically-radial shape suitable for a rotating toy. One end of string 110 is attached to yo-yo axel 130 and the other end is attached to holding ring 120. Holding ring 120 may be made of any suitable material or may be a simple loop at the end of string 110. The end of string 110 that is attached to yo-yo axel 130 may be tied tightly or may form a loose loop around yo-yo axel 130.

If the end of string 110 is tied tightly around yo-yo axel 130 the yo-yo game is quite simple. At first, the player coils string 110 in the narrow recess between the two rounded halves of yo-yo body 100. (The term "coil" or "re-coil" is used in this specification to describe the rolling of string 110 around yo-yo axel 130, or other parts of a yo-yo as will be described in the sequel, to create numerous overlapping loops of string 110, as required at the beginning of the game.) Then the player throws or flings yo-yo body 100 away or downward while gripping holding ring 120. The pull extracted by the extending of coiled string 110 rolls yo-yo body 100 and when string 110 is fully extended it starts to re-coil itself around yo-yo axel 130 and yo-yo body 100 starts rolling upward back to the hand of the player, who may catch the yo-yo. The player can also use hand movements to add inertia to the yo-yo and to repeat the yo-yo up and down movements. This yo-yo game provides limited entertaining experience for the player.

On the other hand, if the end of string 110 forms a loose loop around yo-yo axel 130 the yo-yo game may be more interesting and therefore may provide better entertaining experience. Similar to the simple game, the player coils string 110 and throws or flings yo-yo body 100 away or downward. Once string 110 is fully extended the loose loop at the end of string 110 around yo-yo axel 130 allows yo-yo body 100 to continue rotating while string 110 remains fully extended. In yo-yo players' terminology this state of the yo-yo is called a "sleep" state and one may say that the yo-yo "sleeps," is "sleeping" or such terms. As the yo-yo "sleeps" the player can perform yo-yo "tricks," which are sequences of yo-yo motions that demonstrate the player's skills and agility, all are based on the fact that the rotating yo-yo maintains its orientation as long as it spins fast enough (i.e., the yo-yo preserves its angular momentum, similar to a gyroscope). When the set of tricks is completed the player may perform a short and sharp flick of the arm, the hand or the finger that causes the loose loop at the end of string 110 around yo-yo axel 130 to tighten due to friction and for string 110 to re-coil around yo-yo axel 130 and therefore for yo-yo body 100 to start rolling upward back to the hand of player. This maneuver of the yo-yo is called "waking up" the yo-yo and one may say that the yo-yo "wakes up," is "waking up" or such terms.

Obviously, during the "sleep" state the yo-yo loses some of its rotating speed due to friction between the loose loop at the end of string 110 and yo-yo axel 130 and due to friction between string 110 and the inner walls of the two halves of yo-yo body 100. Modern yo-yo toys may use a ball bearing to reduce the loss of rotating speed during the "sleep" state. FIG. 2 is a schematic side-view of a yo-yo with a ball bearing. Similar to the traditional yo-yo, this yo-yo is also made of yo-yo body 100 connected by yo-yo axel 130. However, for this yo-yo ball-bearing 210 is placed around yo-yo axel 130. Ball-bearing 210 comprises an inner ring that is attached to yo-yo axel 130, an outer case to which string 110 is tied tightly and balls or cylinders that can roll between the inner ring and the outer case, allowing low friction relative rotating between the inner ring and the outer case. Other devices can also be considered as a ball bearing even without the balls or the cylinders, as long as such devices serve the same purpose of allowing a smooth rotation with minimal friction of an inner part in relation to an outer part. Such other devices may use coating by Teflon, silicon, or other polymers or any other method to reduce the friction between the inner part and the outer part of the devices, allowing the smooth rotation with minimal friction between the two parts. Of course, it is also possible to fabricate ball-bearing 210 such that yo-yo axel 130 forms the inner ring of ball-bearing 210. The ball-bearing yo-yo behaves similarly to the traditional yo-yo with a loose loop at the end of string 110 around yo-yo axel 130. However, since ball-bearing 210 almost eliminates the friction between string 110 and yo-yo axel 130, a ball-bearing yo-yo loses its rotating speed much slower than a traditional yo-yo and the player can perform more yo-yo tricks or may just enjoy a longer "sleep" state time. Therefore, a ball-bearing yo-yo provides an enhanced entertaining experience over a traditional yo-yo.

While a ball-bearing yo-yo may maintain its rotating speed longer than a traditional yo-yo, the "waking up" of a ball-bearing yo-yo is usually more difficult than the "waking up" of a traditional yo-yo. The short flick of the hand needs to ensure that the ball-bearing friction is sufficiently increased such that a small new loop and/or a knot of string 110 are formed and that the new loop and/or knot of string 110 generate sufficient initial friction with one of the inner walls of yo-yo body 100 to start the re-coiling of string 110 around axel 130 and therefore to cause the upward rolling motion of the yo-yo. (Ball-bearing yo-yos as depicted in FIG. 2 may use roughing of the surface of the inner walls of yo-yo body 100 close to yo-yo axel 130 to assist in creating the initial friction for "waking up" the yo-yo.) This shows an interesting dilemma in the design of a ball-bearing yo-yo. On one hand, a wider gap between the two rounded halves of yo-yo body 100 will reduce the friction between string 110 and yo-yo body 100 during the "sleep" state. On the other hand, a too wide gap may make the "waking up" of the yo-yo more difficult, since a more "tricky" movement of the hand may be required in order to generate the sufficient initial friction between string 110 and the inner walls of yo-yo body 100. Moreover, a too wide gap may reduce the circumference of the coiled string 110 when it is fully rolled between the two rounded halves of yo-yo body 100 at the beginning of the game, which means that the yo-yo may rotate more slowly when it is thrown. This dilemma is alleviated by some embodiments of the current invention.

FIG. 3 is a schematic diagram of the devices that may be incorporated in computerized yo-yo 300. The physical structure of computerized yo-yo 300 may be similar to the ball-bearing yo-yo depicted in FIG. 2, but computerized yo-yo 300 includes the additional devices described in this specification. The current invention may be implemented with an operating subset of the devices depicted in FIG. 3 or it may be implemented with all the devices depicted in FIG. 3.

The core of computerized yo-yo 300 is computation and control device 305. Computation and control device 305 is configured to receive measurements that indicate the motion of computerized yo-yo 300 from the sensing devices, accelerometers device 315 and tension-meter device 350, together or separately. Computation and control device 305 is configured to generate control signals to control the operation of the elements of computerized yo-yo 300 that enhance the entertaining experience, such as light display device 320, audio play device 325, auxiliary device 330, electric clutch device 335 and electric motor device 340 (the "entertaining elements"). Computation and control device 305 may also receive feedback information from each of the entertaining elements about their status and functionality. Computation and control device 305 may also be connected to communication device 345, which may receive data for computation and control device 305 from an external device and may transmit data from computation and control device 305 to the external device. (Communication device 345 may also send and receive data to and from tension-meter device 350.) The external device may be a handheld device such as smartphone or tablet, which may be connected to communication device 345 by a wireless link that may be WiFi (IEEE 802.11 protocol), Bluetooth protocol, or any other communication protocol that provides a communication link between the external device and communication device 345 of computerized yo-yo 300. Computation and control device 305 and communication device 345 may be implemented separately or may be implemented using the same solid-state electronic microchip, such as, for example, Texas Instrument CC2541 SimpleLink Bluetooth Smart and Proprietary Wireless MCU.

Battery 310 provides power to other devices in computerized yo-yo 300 and is connected to the other devices that are incorporated in a particular embodiment of computerized yo-yo 300. The connections of the battery are not explicitly shown in FIG. 3 for the sake of simplicity. More than one battery may be used in computerized yo-yo 300. Battery 310 may be chargeable with a wired or wireless power supply, or may be chargeable by using electric motor device 340 as a dynamo.

Accelerometers device 315 measures the acceleration values of computerized yo-yo 300 and sends the measured acceleration values to computation and control device 305. The acceleration values of computerized yo-yo 300 are measurements in a sequence of time of the acceleration at one part or at several different parts of computerized yo-yo 300. The acceleration values may indicate the acceleration, the derivative of the acceleration or any other functions or values that can be used to determine the acceleration. Accelerometer technology is a well known art. Accelerometer devices are widely available in the marketplace and custom-made accelerometer devices are also common in the industry, in particular accelerometer devices made of piezoceramic materials. Accelerometers device 315 may be made of pressure or bending piezoceramic materials, but it may also be made of any mechanical, electrical, piezoelectric, piezoresistive, solid-state or any other technology suitable for manufacturing accelerometers device 315.

FIG. 4 is a schematic diagram of an optional configuration of the accelerometers in accelerometers device 315 of computerized yo-yo 300 (FIG. 4 is not to scale). Accelerometers device 315 may be placed at the center of yo-yo body 100. The four individual accelerometer components in FIG. 4 are marked by 410A, 410B, 410C and 410D, but any number of accelerometer components may be used. Each of accelerometer components 410A-410D may be an accelerometer device that includes 3 different accelerometer units (one for each spatial dimension), or may be a single accelerometer unit that measures the acceleration in one direction, which in FIG. 4 is the radial direction. If yo-yo body 100 rotates around yo-yo axel 130 and rolls up and down, but does not move sideways, the configuration depicted in FIG. 4 may be sufficient to measure the acceleration values of these motions. However, since the yo-yo might "wobbles" out of control it may be also beneficial to measure the acceleration perpendicular to the main rotating plane of the yo-yo. If accelerometer components 410A-410D in FIG. 4 are each a single accelerometer unit and therefore each can measure only the acceleration values in one direction (the radial direction), an additional accelerometer component (not shown in FIG. 4) may be used to measure the acceleration values perpendicular to the main rotating plane of the yo-yo. The additional accelerometer component may have different characteristics than of accelerometer components 410A-410D, since the perpendicular acceleration values are expected to be much smaller than the radial acceleration values.

The acceleration values depend on the motion of computerized yo-yo 300 as it is played and the goal of measuring the acceleration values is to extract the information about the motion of computerized yo-yo 300. The extracted information may be used to apply control to the entertaining elements and may be sent to an external device for further analysis, storage or display. The motion information may be the acceleration at any part of computerized yo-yo 300, the derivative of the acceleration at any part of computerized yo-yo 300, the position of the center of computerized yo-yo 300, the speed of the center of computerized yo-yo 300, the rotating speed of computerized yo-yo 300, or any other information that may be used to control the entertaining elements or that may be used for further analysis, storage or display by the external device.

The measured acceleration values may be used to extract the information about the state of computerized yo-yo 300, where a state is an event in time in which computerized yo-yo 300 is in a particular position, moves in a particular motion or is used a particular game configuration, as will become clear by the following example. The example is of a ball-bearing yo-yo game that includes the following sequence of seven states:

State 1: Holding the yo-yo

State 2: Flinging the yo-yo by the player

State 3: Yo-yo downward motion

State 4: Stop of downward motion at the end of the string

State 5: "Sleep" state

State 6: Short yanking of the string to "wake up" the yo-yo

State 7: Yo-yo upward motion

FIG. 5 shows an example of an acceleration curve, which is the representation of the accelerometer values against time, for one of accelerometer components 410A-410D for the game sequence listed above. The x-axis in FIG. 5 is the time in ms units and the y-axis is the acceleration values in $m/s^2$ units.

During state 1, marked by S1 in FIG. 5, the acceleration values will be very small (with the exception of possible short but high acceleration peaks if the yo-yo is banged against some other object, firmly placed in the hand, falling and hitting the floor, etc.). State 1 may be detected by the low level of the average of the median-filtered acceleration values.

During State 2, marked by S2 in FIG. 5, the player flings the yo-yo with a sharp movement of the arm, the hand or the wrist to accelerate the yo-yo away or downward. The acceleration at this step is characterized by a smooth curve, where the amplitude of the curve and its slowly varying slop (the derivative of the acceleration) depend on the player strength and technique. State 2 may be detected by the significant increase in the average of the acceleration values without acceleration spikes.

State 3 starts when the arm, the hand or the wrist flinging movement ends, the yo-yo is released from the hand of the player and starts rolling downward at a fast speed. In this state, marked by S3 in FIG. 5, the acceleration values measured by a radially-placed accelerometer component (similar to ones depicted in FIG. 4) can reach 1500 $m/s^2$ or even higher values. As the yo-yo moves downward the gravitational pull causes the rotating speed of the yo-yo to increase. The rotation of the yo-yo is indicated in segment S3 by the semi-periodical perturbations, caused by the earth gravitational pull, which affects the accelerometer component at an opposite direction each half rotation. The increase in the rotating speed is indicted by the increase in the amplitude of the acceleration values and by the shortening of the time intervals between the semi-periodical perturbations. State 3 may be detected by the significant instantaneous increase in the derivative of the acceleration curve followed by the semi-periodical perturbations with increased average amplitude and increased frequency, which may be detected by identifying the minimum and the maximum points on the acceleration curve.

State 4 happens as the string becomes fully extended and its pull stops the downward motion of the yo-yo. At this step, marked by S4 in FIG. 5, the abrupt break in the yo-yo downward motion will result in very strong peaks in the acceleration curve. The actual values of the acceleration peaks in segment S4 depend on several factors, such as the strength of the initial fling, the mass of the yo-yo and the elasticity of the string. State 4 may be detected by the very large peaks in the acceleration curve.

State 5 is the "sleep" state and is indicted by segment S5 in FIG. 5. Similar to the later part of state 3, the acceleration curve of state 5 exhibits the semi-periodical perturbations caused by the earth gravitational pull. The slow reduction of the rotating speed due to friction is indicated by the slow decrease in the amplitude of the acceleration curve and the increase of the time intervals between the semi-periodical perturbations. The length of the S5 segment will likely be much longer than the length depicted in FIG. 5 and it may be possible for the yo-yo player to perform other yo-yo motions (yo-yo tricks) that start from the "sleep" state of the yo-yo. State 5 may be detected by the smooth average of the acceleration curve and by identifying the minimum and the maximum points on the acceleration curve.

State 6, which is marked by S6 in FIG. 5, happens when the player decides to return the yo-yo to the hand and performs a short downward and upward flick of the arm, the hand or the finger to "wake up" the yo-yo. The short downward motion releases the string and the short upward motion tightens a loop and/or creates a knot near enough to the inner walls of the yo-yo body, which causes the re-coiling of the string around the axel that result in the yo-yo upward motion. The initial downward flick may create a short reduction of the difference between the acceleration minimum points and maximum points since the yo-yo will be in a short near-free-fall condition. This will be followed by sharp peaks in the acceleration curve due to the abrupt changes in the yo-yo motion. The beginning of state 6 may be detected by the short reduction of the difference between the minimum and maximum points of the acceleration curve, which is followed by large peaks in the acceleration curve.

State 7, which is marked by S7 in FIG. 5, is the rolling up of the yo-yo. The acceleration curve exhibits the same periodical perturbations as in states 3 and 5. State 7 may be detected by a significantly lower variance of the acceleration values in comparison to state 6.

FIG. 5 demonstrates that the information about the yo-yo motion and states may be determined by analyzing the acceleration values. The analysis requires the extraction of parameters such as the derivative of the acceleration, the locations and values of the maximum and the minimum points, the locations of changes in the parameters, etc. Such parameters may be used to extract (i.e., calculate) other parameters, such as the position of the center of the yo-yo, the speed of the center of the yo-yo, the rotating speed of the yo-yo, or any other parameter that may be used to control the yo-yo or that provides information about its position, motion or states. FIG. 5 provides an example of the acceleration curve for one of accelerometer components 410A-410D, but the acceleration values from different accelerometer components may be combined and used for the analysis of the yo-yo position, motion or states. For example, the averaging of the acceleration values from all of accelerometer components 410A-410D may provide information about the motion of the center of the yo-yo. We will call the parameters described above by "state parameters" and they may be extracted by computation and control device 305 to be used for the control of other devices in computerized yo-yo 300, or they may also be transmitted using communication device 345 to an external device. The state parameters may initially be any of the parameters that are extracted based on the acceleration values, including, but not limited to, the acceleration values themselves.

It may be possible to employ low-precision accelerometers in computerized yo-yo 300, which might be cheaper, as long as the entertaining goals are achieved. Such low-precision accelerometers may be sufficient for the extraction of the state parameters with sufficient accuracy, even if such low-precision accelerometers may not provide measurements of the acceleration values with the precision required to determine the exact location and the exact motion of computerized yo-yo 300 at all times.

Using tension-meter device 350 may help in improving the detection of the yo-yo motion and states by measuring the tension at the end of string 110 near holding band 120 and providing the tension values to computation and control device 305. Tension-meter device 350 may be comprised of a single piezoceramic element, but it may be made of any mechanical, electrical, piezoelectric, piezoresistive, solid-state or any other technology required for manufacturing tension meter 350. The supply of power and the data transmission may be made through string 110, or tension-meter device 350 may include a micro battery for power supply and may include an auxiliary communication device to communicate with yo-yo communication device 345. In particular, tension-meter device 350 may show significant increase in the tension values at the beginning of states 3, 4 and 6 and therefore it may assist in the detection of the starting instances of these states. Therefore, the state parameters may also include the tension values and any of the parameters that are extracted based on the tension values.

Computation and control device 305 may use the acceleration values from accelerometers device 315 (or the tension values from tension-meter device 350, together or separately), the extracted state parameters and received setup parameters (discussed in the sequel) to generate control signals for the operating of the entertaining elements in computerized yo-yo 300, such as light display device 320, audio play device 325, auxiliary device 330, electric clutch device 335 and electric motor device 340.

Light display device 320 may comprises of any number of light emitting components, such as, but not limited to, LEDs or lasers, which may be placed anywhere inside or on the surface of yo-yo body 100. Light display device 320 may also include wires, electronic switches, dimmers, power amplifiers, or any other component and any of the required connections between these components that may be used to operate the light emitting components. The components of light display device 320 may be located anywhere inside or on yo-yo body 100. Light display device 320 may also be implemented as a detachable device, as will be discussed in the sequel. Some examples of operating light display device 320 are, but not limited to, low or soft lights when computerized yo-yo 300 is held (state 1), light fleshes when computerized yo-yo 300 is thrown (state 2 to state 3), reaches the end of string 110 (state 4), or "wakes up" (state 6). In other examples, based on the configuration of the light emitting components and the motion and the states of computerized yo-yo 300, lights synchronized with the yo-yo motion can provide entertaining effects, such as light flashes that appear stationary despite the rotating of computerized yo-yo 300 or display of figures or characters that can appear to be stationary or that can move in an entertaining pattern. Further, in synchronization with audio play device 325, the light display may be synchronized with the beat and/or the intensity of the audio played by audio play device 325. The light patterns may be fixed, or they may be changeable, loadable or programmable, as will be discussed in the sequel.

Audio play device 325 may comprises of electrical, electromechanical, electromagnetic or piezoelectric components that can be used to produce audible sounds. Such components may be loudspeakers, memory components used to hold pre-stored or loadable audio files or audio formats (such as MIDI), digital-to-analog converters, power amplifiers, or any other component and any of the required connections between these components. The components of audio play device 325 may be located anywhere inside or on yo-yo body 100. Audio play device 325 may also be implemented as a detachable device, as will be discussed in the sequel. Audio play device 325 may be used to play entertaining audio as the player plays with computerized yo-yo 300, such as music, sound effects, human voice, animal sounds, or any other entertaining and exciting audios and sounds. Some examples of operating audio play device 325 are, but not limited to, playing soft music when computerized yo-yo 300 is held (state 1), generating loud noisy bangs when computerized yo-yo 300 thrown (state 2 to state 3), reaches the end of string 110 (state 4), or "wakes up" (state 6). In another example, the audio may be played with a beat that corresponds to the rotating speed of computerized yo-yo 300. The entertaining audio information, such as recorded audio (music, voices, noises, etc.), MIDI format data or any other audio data, may be fixed and pre-stored in memory components, or the audio information may be changeable, loadable or programmable as will be discussed in the sequel.

It is possible to build computerized yo-yo 300 with fixed entertaining elements, such as light display device 320 on one side of computerized yo-yo 300 and audio play device 325 on the other side of computerized yo-yo 300, or even a device that combines light display device 320 and audio play device 325 built together at each side of computerized yo-yo 300, or any other arrangement or configuration of such entertaining elements. However, an enhanced entertaining experience may be achieved if these entertaining elements (as well as auxiliary device 330, described in more details in the sequel) are made detachable such that different types of detachable devices may be attached to computerized yo-yo 300 and can be replaced with other detachable devices if needed.

FIGS. 6A, 6B and 6C describe a possible implementation of latching base 605 for detachable devices which may be fabricated into yo-yo body 100 and in particular into one or both of the rounded halves of yo-yo body 100. Latching base 605 may be formed by a recessed space in yo-yo body 100 and the detachable devices may be inserted into latching base 605 and held by latches 610A, 610B, 610C and 610D. Latching base 605 may also include connecting pad 615 and padding ring 620. Connecting pad 615 in latching base 605 may be made of strips of metal, such as cupper, that provide electrical signals and power from yo-yo body 100 to the detachable devices latched to latching base 605. Padding ring 620 may be made of rubber or silicon to provide cushioning and resistance. One of latches, such as latch 610A, may be configured to be moveable, where pushing spring 630 may push latch 610A toward the center of latching base 605. Detachable devices may be inserted into latching base 605 under latches 610B, 610C and 610D and held firmly in place by latch 610A as it is pushed by pushing spring 630. Obviously, any other configuration of holding, latching or connecting the detachable devices is possible. As examples, but not limited to, the recessed space of latching base 605 may be a square, a rectangular, a hexagonal or any other shape. Moreover, instead of using a recessed space for latching base 605, the detachable devices may be inserted into a slit in yo-yo body 100, which may function as another embodiment of latching base 605. In another configuration, the recessed space may be eliminated such the detachable devices are latched to the outer surface of one or both of the round halves of yo-yo body 100. Any number of latches may be used and may be replaced by, but not limited to, pins, holes, grooves, screws, or any other mechanism that may hold the detachable deices firmly in place. Any number of the latches may be configured with pushing spring 630 and pushing spring 630 may be replaced with any other mechanism that facilitates the latching of the detachable devices. Connecting pad 615 of latching base 605 may be made of any material and shape that provide the connection of electrical signals and power supply to the detachable devices, such as, but not limited to, metal pins that fit into metal holes for electrical connectivity. Moreover, several connecting pads may be used instead of the single connecting pad 615. Padding ring 620 may be of any shape and material, including non-ring forms such a padding surface, as long as it provides the cushioning and the resistance. Latching base 605 may be implemented without one or any of the features described in FIGS. 6A, 6B and 6C, as long as latching base 605 is capable of holding and connecting the detachable devices to yo-yo body 100.

FIG. 7 shows a first possible embodiment of light display device 320 as a detachable device, implemented as a rounded disk. Detachable device connecting pad 710 is placed on the down side of the detachable device and provides the electrical connection with connecting pad 615 of latching base 605. Both pads should be made to complement each other in order to provide the electrical connections. Any number of light-emitting components 720, such as, but not limited to, LEDs, may be placed on the up side of the detachable device at any desired configuration of locations, sizes, colors, or any other attribute of light-emitting components 720. Other supporting components, such as, but not limited to, memory, switches, dimmers, impedance converters, power amplifiers or any other component needed for the operations of light display device 320 and light-emitting components 720 may be placed inside or on the body of the detachable device or may be placed inside or on yo-yo body 100.

FIG. 8 shows a second possible embodiment of light display device 320 as a detachable device, also implemented as a rounded disk. Any number of lasers may be placed on the up side of the detachable device, including, for example, laser 810. The following discussion of laser 810 is applicable to any other laser in this embedment. Laser 810 is attached to the up side of the detachable device by holder 820 and may be placed, attached or glued above piezo-actuator 830. Therefore, in addition to turning laser 810 on or off, it is also possible to steer the light beam of laser 810 in a range of angles by applying or un-applying electrical signals to piezo-actuator 830. Piezo-actuator 830 may be replaced by any mechanism, mechanical, electromechanical, electromagnetic, or any other technology that may be used steer the light beam of laser 810 in a range of angles. Moreover, laser 810 may be placed on or inside the detachable device and the steering of the light beam of laser 810 may be achieved by moving a mirror or mirrors, rather than moving laser 810. Other supporting components, such as, but not limited to, memory, switches, dimmers, impedance converters, power amplifiers or any other component needed for the operations of light display device 320, laser 810 and piezo-actuator 830 may be placed inside or on the body of the detachable device or may be placed inside or on yo-yo body 100. This second possible embodiment of light display device 320 includes an implementation of detachable device connecting pad 710, not shown in FIG. 8.

FIG. 9 shows a possible embodiment of audio play device 325 as a detachable device, implemented as a rounded disk. The implementation of audio play device 325 requires membrane 910 and a mechanism (not shown in FIG. 9) that moves membrane 910 according to an electrical signal. Audio play device 325 may use a piezoelectric mechanism to move membrane 910, but any other mechanisms, such as, but not limited to, electromagnetic or capacitance mechanisms, may be used. Other supporting components, such as, but not limited to, memory, digital-to-analog converters, impedance converters, power amplifiers or any other component needed for the operations of audio play device 325 and membrane 910 may be placed inside or on the body of the detachable device or may be placed inside or on yo-yo body 100. This possible embodiment of audio play device 325 includes an implementation of detachable device connecting pad 710, not shown in FIG. 9.

Using detachable devices latched to latching base 605 for light display device 320 or audio play device 325 provides several advantages, such as the possibility to use the same computerized yo-yo 300 with different and new types of detachable devices or the ability for good commercial tradeoffs between performance and price for the detachable devices. However, latching base 605 may also be used to hold another type of detachable devices, which we will call auxiliary device 330. Auxiliary device 330 may be a disposable or semi-disposable detachable device, which may provide additional entertaining value to computerized yo-yo 300. FIG. 10 is a schematic diagram of a possible embodiment of auxiliary device 330, implemented as a detachable device in the form of a rounded disk. Several entertaining payloads 1010 are distributed on the up side of the detachable device. Entertaining payloads 1010 may be miniature firework payloads, colored smoke payloads, colored powder payloads or scent payloads. Entertaining payloads 1010 may also be miniature capsules that hold fun miniature treats, such as sweets or accessories, or any other payload that provides entertaining experience for the player of computerized yo-yo 300. Entertaining payloads 1010 may use pyrotechnical mechanism or any other activating mechanism to fire the fireworks, dispose the smoke, the powder or the scents, open the capsules or activate any other entertaining feature of entertaining payloads 1010. The distribution of entertaining payloads 1010 on the up side of the detachable device may be structured and distributed as depicted in FIG. 10, or may be structured and distributed at any pattern and form on or inside the detachable device. Other supporting components needed for the operations of auxiliary device 330 and entertaining payloads 1010 may be placed on or inside the body of the detachable device or may be placed on or inside yo-yo body 100. This possible embodiment of auxiliary device 330 includes an implementation of detachable device connecting pad 710, not shown in FIG. 10.

Obviously, many different types of detachable devices may be designed and latched to latching base 605, with the goal of enhancing the entertaining experience. A type of detachable device may be any particular embodiment of light display device 320, any particular embodiment of audio play device 325 or any particular embodiment of auxiliary device 330. Since different types of detachable devices may be latched to latching base 605, computation and control device 305 can be configured to use an identification mechanism to identify the type of detachable device that is latched to latching base 605. Computation and control device 305 may then be able to generate control signals that are based on the identified type of detachable device and that are suitable for the identified type of detachable device for achieving a desired entertaining experience. The identification mechanism may be an analog mechanism, such as a resistor having a different resistance for each different type of detachable device, wherein the resistance may be measured by computation and control device 305 to identify which type of detachable device is latched to latching base 605. The identification mechanism may also be a digital mechanism, such as a memory component that stores a different identification code for each different type of detachable device, wherein the identification code may be read by computation and control device 305 to identify which type of detachable device is latched to latching base 605. The identification mechanism may be any mechanism that can be used by computation and control device 305 to identify the type of detachable device that is latched to latching base 605.

As a first example of using the identified type of detachable device, if computation and control device 305 identifies that the detachable device is light display device 320 as depicted in FIG. 7 and if the acceleration values indicate that computerized yo-yo 300 is rotating at speed R, measured for example in rounds-per-second, computation and control device 305 may generate control signals suitable for light display device 320 such that light-emitting components 720 flash at a rate of $F_R$=4R in flashes-per-second. As a second example of using the identified type of detachable device, if computation and control device 305 identifies that the detachable device is audio play device 325 as depicted in FIG. 9 and if the acceleration values indicate that computerized yo-yo 300 is rotating at speed R, measured for example in rounds-per-second, computation and control device 305 may generate control signals suitable for audio play device 325 such that membrane 910 vibrates with a beat of $B_R$=R in beats-per-second.

Computation and control device 305 may generate predetermined control signals to operate the detachable devices that are latched to lathing base 605 according to the detected type of the detachable device, i.e., a particular type of detachable device will operate in a similar way each time it is latched to latching base 605. However, it may be possible to operate a particular type of detachable device in many different ways using many different sets of control signals to achieve different entertaining experience. In addition, it may be possible that a new type of detachable device will be used, a type to which computation and control device 305 may not have suitable control signals. Therefore it may be beneficial if new control signals can be loaded to computation and control device 305 or generated by computation and control device 305 using setup parameters. The setup parameters may be the complete control signals to be used by computation and control device 305 to operate the detachable devices or may be parameters that may be used by computation and control device 305 to generate the control signals to operate the detachable devices. Therefore, communication device 345 may be configured to receive setup parameters from an external device and to send the received setup parameters to computation and control device 305. As examples, but not limited to, the setup parameters may be the light patterns for light display device 320, the audio data for audio play device 325, or the timing and conditions for the activating of auxiliary device 330. In another example, the setup parameters may be which player out of several players is currently playing with computerized yo-yo 300.

The setup parameters may be any information received from the external device and used for any of the extraction of the state parameters, the generating of the control signals and the operation of the entertaining elements. As an example, if the setup parameters indicate that player A is currently playing with computerized yo-yo 300 and the acceleration values indicate that computerized yo-yo 300 is "waking up," the extracted state parameters and the generated control signals may control light display device 320 to flash in a red color. On the other hand, if the setup parameters indicate that player B is currently playing with computerized yo-yo 300 and the acceleration values indicate that computerized yo-yo 300 is "waking up," the extracted state parameters and the generated control signals may control light display device 320 to flash in a yellow color.

The external device may receive the setup parameters from any source, such as loading the setup parameters from any storage media or from the Internet. Moreover, using a specific program or application on the external device or any other device, a user may be able to generate new and interesting setup parameters for any entertaining element and any type of detachable device, which may then be sent to computation and control device 305 and be used to operate any of the entertaining elements in computerized yo-yo 300 in a new, interesting, entertaining and exciting ways.

In addition, computation and control device 305 may use communication device 345 to send to the external device the information about the yo-yo movement and states. Computation and control device 305 may use the acceleration values from accelerometers device 315 (or the tension values from tension-meter device 350, together or separately) and any other information is receives from the entertaining elements to extract the state parameters and to send the state parameters to the external device using communication device 345. For example, the state parameters may include the identity of the detachable device latched to latching base 605 and the information about the condition of any device or element of computerized yo-yo 300. Therefore, the state parameters are any of the parameters received by computation and control device 305, extracted by computation and control device 305 or generated by computation and control device 305. The external device may use the state parameters it receives from computation and control device 305 for additional entreating experience, such as, but not limited to, displaying the yo-yo rotating speed, declaring who of two players achieved the highest throwing force or who played with computerized yo-yo 300 the longest or in the best way according to some possible game requirements, or any other usage of the information about computerized yo-yo 300 movement, state and condition that may enhance the entertaining experience for the players. Moreover, the external device may also use the information about the yo-yo movement, state and condition it receives from computation and control device 305 to calculate complicated control parameters, which may require stronger computation power than the computation power of computation and control device 305, and then to send the computed complicated control parameters back to computation and control device 305 to assist in generating the control signals for the entertaining elements that provide the desired entertaining experience.

Light display device 320, audio play device 325 and auxiliary device 330 may create entertaining experience for the players by responding to computerized yo-yo 300 movement, state and condition. However, a further enhanced entertaining experience may be achieved if the motion of computerized yo-yo 300 can be controlled and manipulated. FIG. 11 is a schematic diagram of computerized yo-yo 300 with ball-bearing 210 and electric clutch device 335. Similar to the ball-bearing yo-yo described in FIG. 2, this embodiment of computerized yo-yo 300 includes ball-bearing 210 with an inner ring attached to yo-yo axel 130 and an outer case. Electric clutch device 335 may be made of piezoelectric clutch components 1105 that may be attached to yo-yo body 100 and placed at about the same distance from yo-yo axel 130 as the outer case of ball-bearing 210. Piezoelectric clutch components 1105 may be expended or contracted by applying (or un-applying) electrical signals. FIG. 11 depicts four clutch components 1105, two at each side of yo-yo body 100, but any number of clutch components 1105 at any configuration may be used. Moreover, any other technology may be used to implement clutch components 1105, such as, but not limited to, magnetic, electromagnetic or electromechanical technologies. Other elements required for the operation of electric clutch device 335 and clutch components 1105, such as, but not limited to, wiring, switches, power amplifiers or any other element are not shown in FIG. 11.

Clutch components 1105 may be configured such that they contract when an electric signal is applied (or when an electric signal is un-applied), eliminating any contact or friction between clutch components 1105 and the outer case of ball-bearing 210, which we will call "unlocked." Clutch components 1105 may be further configured such that they expend when an electric signal is un-applied (or when an electric signal is applied), creating contact and friction with the outer case of ball-bearing 210, which we will call "locked." The contact and friction between clutch components 1105 and the outer case of ball-bearing 210 create a friction force between yo-yo body 100 and the outer case of ball-bearing 210, in the sense that this force affects (slows) the relative motion between yo-yo body 100 and the outer case of ball-bearing 210. The friction force may be used to control the relative motion between yo-yo body 100 and the outer case of ball-bearing 210 and therefore also between yo-yo body 100 and string 110. For example, if clutch components 1105 are unlocked, the outer case of ball-bearing 210 is free to rotate, which means that the motion of computerized yo-yo 300 will be identical to the motion of the ball-bearing yo-yo described in FIG. 2. In yet another example, when clutch components 1105 are locked the outer case of ball-bearing 210 will rotate together with yo-yo body 100, which means that the motion of computerized yo-yo 300 will be similar to the motion described for the simple yo-yo in FIG. 1 with the end of string 110 tied tightly around yo-yo axel 130. However, enhanced entertaining experience may be achieved if the operation of electric clutch device 335 is controlled by control signals generated by computation and control device 305. The control signals for electric clutch device 335 (the electric clutch control signals) may be based on the acceleration values from accelerometers device 315 (or the tension values from tension-meter device 350, together or separately), the state parameters extracted by computation and control device 305, or the setup parameters received from an external device, together or separately. For example, the electric clutch control signals may control clutch components 1105 to be locked as the player throws computerized yo-yo 300 and then the electric clutch control signals may control clutch components 1105 to be unlocked exactly when string 110 is fully extended, as indicated by the acceleration values from accelerometers device 315 (or the tension values from tension-meter device 350, together or separately). This will result in a higher efficiency, in the sense of increased rotating speed during "sleep" state, in comparison to the ball-bearing yo-yo described in FIG. 2. (For the ball-bearing yo-yo, string 110 may lose its friction with the internal walls of yo-yo body 100 before string 110 is fully extended.) In another example, the electric clutch control signals may control clutch components 1105 to be unlocked and computerized yo-yo 300 may be in a "sleep" state, and then the acceleration values from accelerometers device 315 (or the tension values from tension-meter device 350, together or separately) may indicate that the player is "waking up" the yo-yo, which may cause computation and control device 305 to generate the electric clutch control signals to control clutch components 1105 to be locked. This may result in a faster and easier "waking up" of computerized yo-yo 300 in comparison to "waking up" of the ball-bearing yo-yo described in FIG. 2. (For the ball-bearing yo-yo, the player needs to manipulate string 110 to generate sufficient friction between string 110 and the internal walls of yo-yo body 100.) In yet another example, computerized yo-yo 300 may be in a "sleep" state with clutch components 1105 unlocked when the player issues a voice command to the external device, such as pronouncing the word "up." The voice command may be recognized by the external device that can send suitable setup parameters via communication device 345 to computation and control device 305, which may then generate the electric clutch control signals to control clutch components 1105 to lock, which will cause computerized yo-yo 300 to start rolling upward. Even if the yo-yo player does not want electric clutch device 335 to assist or interfere with computerized yo-yo 300 motion during the game, it is possible to use electric clutch device 335 simply in assisting the re-coiling of string 110 in order to re-start the game. In this example, when string 110 is fully extended but computerized yo-yo 300 is not rotating any more, as may happen when the player loses control of the yo-yo, the player needs to re-coil string 110 to be able to re-start the game. For the ball-bearing yo-yo described in FIG. 2 the re-coiling is not simple, since the player needs to carefully manipulate string 110 to generate the initial friction that will allow the re-coiling to happen. For computerized yo-yo 300 with electric clutch device 335 the player may simply issue a voice command, such as "lock," to the external device. The voice command may be recognized by the external device that can send suitable setup parameters via communication device 345 to computation and control device 305, which may then generate the electric clutch control signals to control clutch components 1105 to lock. Once clutch components 1105 are locked the player can easily re-coil string 110, issue a second voice command such as "unlock," which will result in the unlocking of clutch components 1105, and then the player can simply re-start the yo-yo game. In yet another example, instead of issuing a voice command such as "lock," the player may move computerized yo-yo 300 in a first particular motion pattern that will be detected by computation and control device 305 based on the acceleration values from accelerometers device 315 and that will result in locking of clutch components 1105. After string 110 is re-coiled the player may move computerized yo-yo 300 in a second particular motion pattern that will be detected by computation and control device 305 based on the acceleration values from accelerometers device 315 and that will result in unlocking of clutch components 1105.

Moreover, using varying levels of electric clutch control signals for clutch components 1105 in electric clutch device 335 it may be possible to create varying degree of friction between clutch components 1105 and the outer case of ball-bearing 210 and therefore a varying degree of the friction force between yo-yo body 100 and the outer case of ball-bearing 210. The varying degree of friction force may be used for smooth control of computerized yo-yo 300 motion, such as gradually slowing the rotating speed of computerized yo-yo 300 or controlling the rotating speed of computerized yo-yo 300 as it moves upward when it "wakes up." For example, the "waking up" in the ball-bearing yo-yo described in FIG. 2 is very abrupt and the yo-yo returns very fast and with considerable force (depending on its rotating speed when it "wakes up") to the hand of the player. Using suitable electric clutch control signals for clutch components 1105 in electric clutch device 335 it may be possible to "wake up" computerized yo-yo 300 in a gradual way and to control its upward speed for a less-forceful return to the hand of the player.

As discussed above, the width of the gap between the two rounded halves of yo-yo body 100 is a compromise between the need to reduce the friction between string 110 and the inner walls of yo-yo body 100 during the "sleep" state (which requires a wide gap) and the need for easy "waking up" of the yo-yo (which requires a narrow gap). In addition, a narrow gap may help to create a larger circumference for string 110 when it is coiled, which increases the rotating speed generated by the initial throw of the yo-yo. FIG. 12 describes computerized yo-yo 300 where the outer case of ball-bearing 210 is further fitted with internal disks 1220 that help to resolve this issue. Similar to FIG. 11, this computerized yo-yo 300 also includes electric clutch device 335 implemented by clutch components 1105. Obviously, if clutch components 1105 are unlocked, the player may fling computerized yo-yo 300 depicted in FIG. 12 and when string 110 is fully extended computerized yo-yo 300 depicted in FIG. 12 will enter a "sleep" state. However, it would be impossible for the player to use arm, hand or finger movements to "wake up" computerized yo-yo 300 depicted in FIG. 12, since it will be impossible to create the friction between string 100 and the inner walls of yo-yo body 100, as the inner walls of yo-yo body 100 are at the outer side of internal disks 1220. However, since clutch components 1105 may be controlled by computation and control device 305, it may be possible to "wake up" computerized yo-yo 300 depicted in FIG. 12 by the locking of clutch components 1105. Note, in particular, that for computerized yo-yo 300 depicted in FIG. 12, string 110 and internal disks 1220 do not move relative to one another during the "sleep" state and therefore the friction of string 110 with the internal walls of yo-yo body 100 during the "sleep" state is eliminated. This means that computerized yo-yo 300 depicted in FIG. 12 with internal disks 1220 may be more efficient in the sense that it may rotate longer during "sleep" state. Moreover, computerized yo-yo 300 depicted in FIG. 12 with internal disks 1220 may be made with a narrow gap between the two halves of yo-yo body 100, which may increase the circumference for string 110 when it is coiled and this in turn may increase the rotating speed generated by the initial throw of computerized yo-yo 300 depicted in FIG. 12. Other elements required for the operation of electric clutch device 335 and clutch components 1105, such as, but not limited to, wiring, switches, power amplifiers and any other element are not shown in FIG. 12.

When a yo-yo is in a "sleep" state and it rotates fast enough a player may perform yo-yo "tricks," which are sequences of yo-yo motions that demonstrate the player's skills and agility. However, as the rotating speed is slowed due to friction the ability to perform the yo-yo tricks is reduced or eliminated. FIG. 13 depicts computerized yo-yo 300 that incorporates electric clutch device 335 and electric motor device 340 for generating improved entertaining experience for the player. Electric motor device 340 may be comprised of electric motor 1310 that is mounted on axel 130 similar to ball-bearing 210 in FIGS. 2, 11 and 12. Electric motor 1310 may have an inner component (equivalent to the inner ring of ball-bearing 210) that may hold electrical coils and an outer case (equivalent to the outer case of ball-bearing 210) that may hold fixed magnets. Assuming that clutch components 1105 are unlocked, when no control signals are applied to electric motor 1310 the inner component may rotate smoothly and with minimal friction in relation to the outer case, similar to ball-bearing 210. When control signals are applied to electric motor 1310, a rotating force may be generated between the inner component and the outer case of electric motor 1310. Since the inner component of electric motor 1310 is attached to yo-yo axel 130 that in turn is attached to yo-yo body 100, the generated rotating force is also applied between the outer case of electric motor 1310 and yo-yo body 100. If yo-yo body 100 and the outer case of electric motor 1310 are not initially rotating relative to each other, the rotating force may generate a rotating motion between them. If yo-yo body 100 and the outer case of electric motor 1310 are already rotating relative to each other, the rotating force may increase or may decrease the speed of this rotation, or the rotating force may even reverse the direction of this rotation. String 110 may be tied to the outer case of electric motor 1310, which functions as the outer case of ball-bearing 210 in the FIGS. 2, 11 and 12.

Electric clutch device 335 and electric motor device 340 may be controlled by computation and control device 305 that may generate the electric clutch control signals and the control signals for electric motor device 340 (the electric motor control signals) based on acceleration values from accelerometers device 315 (or the tension values from tension-meter device 350, together or separately), the state parameters extracted by computation and control device 305, or the setup parameters received from an external device, together or separately. For example, after the player flings computerized yo-yo 300 depicted in FIG. 13, clutch components 1105 may be unlocked and electric motor device 340 may operate to increase the rotating speed of computerized yo-yo 300 as it moves downward. In yet another example, when string 110 is fully extended and computerized yo-yo 300 depicted in FIG. 13 is in a "sleep" state, electric motor device 340 may be controlled and operate to keep the rotating speed constant, which may allow the player to perform a long sequence of yo-yo trick elements. In yet additional example, when the player completes the trick elements it may be possible to "wake up" computerized yo-yo 300 depicted in FIG. 13 by the friction force generated by clutch components 1105 or by the rotating force generating by electric motor 1310. In yet further example, as the player performs the yo-yo tricks elements, the player may issue voice commands, such as "faster," "slower," "up," "down," to an external device, which may be recognized by the external device that may send setup parameters via communication device 345 to computation and control device 305 to generate electric clutch control signals to control electric clutch device 335 and to generate electric motor control signals to control electric motor device 340, together or separately, to control the motion or the state of computerized yo-yo 300 according to the issued voice commands. Other elements required for the operation of electric clutch device 335, electric motor device 340, clutch components 1105 and electric motor 1310, such as, but not limited to, wiring, switches, power amplifiers and any other element are not shown in FIG. 13.

Other embodiments of electric motor device 340 are possible, as long as they function such that as electric motor control signals are generated and applied to electric motor device 340, electric motor device 340 generates a rotational force that influences the motions of computerized yo-yo 300 as required. Further, electric motor device 340 may reverse its function and operate as a dynamo to recharge battery 310.

Several features and different aspects of the current invention were presented separately in FIGS. 3-13. However, it is possible to implement computerized yo-yo 300 in any embodiment that combines any of the features and the different aspect of the current invention. For example, but not limited to, an embodiment of computerized yo-yo 300 may be comprised of latching base 605 to which detachable types of light display device 320, audio play device 325 or auxiliary device 330 may be latched. The same embodiment of computerized yo-yo 300 may be further comprised of electric clutch device 335 and electric motor device 340 that may provide control of the motion of computerized yo-yo 300.

The invention claimed is:

1. A computerized yo-yo, the computerized yo-yo comprising:

a yo-yo body comprised of a first rounded half and a second rounded half;

a latching base formed as a recessed space into at least one of the first rounded half and the second rounded half of the yo-yo body wherein the latching base comprises a latch and a first connecting pad;

an electronic detachable device wherein the electronic detachable device is held by the latch to the latching base, wherein the electronic detachable device comprises a second connecting pad and wherein the electronic detachable device is of a type from a plurality of types of electronic detachable devices comprising a light emitting device type, an audio play device type and an auxiliary device type interchangeably held to the latching base;

an accelerometers device configured to measure acceleration values of the computerized yo-yo;

a computation and control device configured to receive the measured acceleration values, to identify the type of the electronic detachable device held to the latching base and to generate control signals for the electronic detachable device held to the latching base based on the measured acceleration values and based on the identified type of the electronic detachable device held to the latching base, wherein the computation and control device is further configured to transmit the generated control signals to the electronic detachable device held to the latching base using a connection between the first connecting pad and the second connecting pad.

2. The computerized yo-yo of claim 1, wherein the light emitting device type comprises at least one of a light emitting diode (LED) and a laser and wherein the light emitting device type is configured to emit light based on the generated control signals.

3. The computerized yo-yo of claim 1, wherein the audio play device type comprises at least one of a piezoelectric mechanism, an electromagnetic mechanism and a capacitance mechanism and wherein the audio play device type is configured to play audio based on the generated control signals.

4. The computerized yo-yo of claim 1, wherein the auxiliary device type comprises at least one of a firework payload, a colored smoke payload, a colored powder payload and a scent payload and wherein the auxiliary device type is configured to dispose at least one of a firework, a colored smoke, a colored powder and a scent based on the generated control signals.

5. The computerized yo-yo of claim 1, further comprising:

a communication device configured to receive setup parameters from an external device and to send the received setup parameters to the computation and control device;

wherein the computation and control device is further configured to generate the control signals based on the received setup parameters.

6. The computerized yo-yo toy of claim 1, further comprising:

a communication device, wherein the computation and control device is further configured to extract at least one state parameters based on at least one of the measured acceleration values and the identified type of the electronic detachable device held to the latching base and wherein the communication device is configured to send the at least one extracted state parameters to an external device.

7. A method for generating control signals in a computerized yo-yo, the method comprises:

holding an electronic detachable device by a latch to a latching base formed as a recessed space on the computerized yo-yo, wherein the electronic detachable device is of a type from a plurality of types of electronic detachable devices interchangeably held to the latching base and wherein the plurality of types of detachable devices comprises a light emitting device type, an audio play device type and an auxiliary device type;

measuring acceleration values of the computerized yo-yo using an accelerometer device;

identifying the type of the electronic detachable device held to the latching base;

generating control signals by a computation and control device for the electronic detachable device held to the latching base based on the measured acceleration values and based on the identified type of the electronic detachable device held to the latching base;

transmitting the generated control signals from the computation and control device to the electronic detachable device held to the latching base using a connection between a first connecting pad on the latching base and a second connecting pad on the electronic detachable device held to the latching base.

8. The method of claim 7, further comprising:

emitting light based on the generated control signals if the type of the electronic detachable device held to the latching base is the light emitting device type.

9. The method of claim 7, further comprising:

playing audio based on the generated control signals if the type of the electronic detachable device held to the latching base is the audio play device type.

10. The method of claim 7, further comprising:

disposing at least one of a firework, a colored smoke, a colored powder and a scent based on the generated control signals if the type of the electronic detachable device held to the latching base is the auxiliary device type.

11. The method of claim 7, further comprising:

receiving setup parameters from an external device by a communication device and sending the received setup parameters to the computation and control device;

wherein the computation and control device further generates the control signals based on the received setup parameters.

12. The method of claim 7, further comprising:

extracting at least one state parameters by the computation and control device based on at least one of the measured acceleration values and the identified type of the electronic detachable device held to the latching base;

sending the extracted at least one state parameters by a communication device to an external device.

* * * * *